US005715720A

United States Patent [19]

Balve et al.

[11] Patent Number: 5,715,720

[45] Date of Patent: Feb. 10, 1998

[54] DEVICE FOR AUTOMATICALLY POSITIONING A ROLL STAND WITH GROOVED ROLLS AND REST BARS AND ROLL FITTINGS IN FRONT OF THE ROLL STAND RELATIVE TO ROLL CENTER

[75] Inventors: Karl-Heinz Balve; Albert Hauch, both of Hilchenbach, Germany

[73] Assignee: SMS Schloemann-Siemag Aktiengesellschaft, Düsseldorf, Germany

[21] Appl. No.: 596,890

[22] Filed: Mar. 12, 1996

[30] Foreign Application Priority Data

Mar. 13, 1995 [DE] Germany ..... 195 08 972.3

[51] Int. Cl.[6] ..... B21B 31/07

[52] U.S. Cl. ..... 72/239; 72/237

[58] Field of Search ..... 72/210, 221, 222, 72/237, 238, 239, 245, 247, 248, 252.5

[56] References Cited

U.S. PATENT DOCUMENTS

| | | | |
|---|---|---|---|
| 3,675,455 | 7/1972 | Schneider | 72/238 |
| 4,470,283 | 9/1984 | Schnyder | 72/238 |
| 4,471,642 | 9/1984 | Wilson | 72/239 |
| 4,686,845 | 8/1987 | Sugar | 72/237 |
| 4,905,493 | 3/1990 | Benedetti | 72/238 |
| 4,944,175 | 7/1990 | Sugar | 72/238 |
| 4,974,437 | 12/1990 | Schiller | 72/238 |
| 5,146,409 | 9/1992 | Atkinson | 72/247 |
| 5,195,345 | 3/1993 | Porombka et al. | 72/237 |
| 5,195,346 | 3/1993 | Braun et al. | 72/247 |

FOREIGN PATENT DOCUMENTS

| | | | |
|---|---|---|---|
| 3325841 | 1/1985 | Germany . | |
| 1754271 | 8/1992 | U.S.S.R. | 72/241.8 |
| 2114929 | 9/1983 | United Kingdom | 72/239 |

*Primary Examiner*—Lowell A. Larson
*Assistant Examiner*—Ed Tolan
*Attorney, Agent, or Firm*—Friedrich Kueffner

[57] ABSTRACT

A device for automatically positioning a roll stand with grooved rolls and rest bars and roll fittings arranged in front of the roll stand relative to roll center includes a stationary guide frame for receiving the supports of the roll fitting. The roll stand is mounted on the guide frame so as to be displaceable relative to this support and so as to be fastenable relative to the support. The supports of the roll fittings are hinged to the guide frame so as to be pivotable about an axis extending parallel to the roll axes and transversely to the rolling direction.

2 Claims, 3 Drawing Sheets

DEVICE FOR AUTOMATICALLY POSITIONING A ROLL STAND WITH GROOVED ROLLS AND REST BARS AND ROLL FITTINGS IN FRONT OF THE ROLL STAND RELATIVE TO ROLL CENTER

BACKGROUND OF THE INVENTION

1. Field of the Invention

The present invention relates to a device for automatically positioning a roll stand with grooved rolls and rest bars and roll fittings arranged in front of the roll stand relative to roll center.

2. Description of the Related Art

Known devices of the above-described type all have a roll fitting which is fixed relative to the rolling line and is installed outside of the stand.

Because of unavoidable tolerances, it is never possible to achieve the necessary accuracy when the above-described devices are used for displacing the roll stand with the grooved rolls for the alignment thereof relative to the roll fittings and the roll center. In addition, this alignment is made more difficult by the large amount of dirt which accumulates at roll stands.

SUMMARY OF THE INVENTION

Therefore, it is the primary object of the present invention to eliminate the above-described difficulties and disadvantages in the alignment and to simplify the alignment.

In accordance with the present invention, a stationary guide frame is provided for receiving the supports of the roll fitting. The roll stand is mounted on the guide frame so as to be displaceable relative to this support and so as to be fastenable relative to the support.

This configuration of the device makes it possible that, after the displacement of the roll stand, the respective grooves of the rolls are automatically aligned and secured relative to the roll fittings which have already been positioned with their carrier in the rolling line.

In accordance with a further development of the present invention, the supports of the roll fittings can be hinged to the guide frame so as to be pivotable about an axis which extends parallel to the roll axes and transversely of the rolling direction. Positioning recesses corresponding to the grooves of the rolls may be arranged in the rest bars which are fixedly connected to the roll stand and a positioning stop which can be inserted into the recesses may be provided on the support of the roll fittings.

In the case of horizontal roll stands, the support of the roll fittings may be a hinge element which is connected, on the one hand, to the guide frame and, on the other hand, is hinged to a crossbar which connects the two housings of the roll stand and extends parallel to the roll axes above the rolling line.

Spray nozzle carriers for cooling agents to be applied to the rolls may be arranged on the supports of the roll fitting above and possibly below the fittings. These spray nozzle carriers may be mounted so as to be pivotable about the pivoting axis of the supports of the roll fittings and so as to be fastenable to this pivoting axis. The spray nozzle carriers may be equipped with adjustment stops resting directly or indirectly against the roll stand.

In addition, a spindle displacement device, which is known in the art, may be provided fixedly attached to the guide frame and connected to the roll stand, wherein the spindle displacement device acts against the pressure of a hydraulic buffer.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENT

Figure 2:
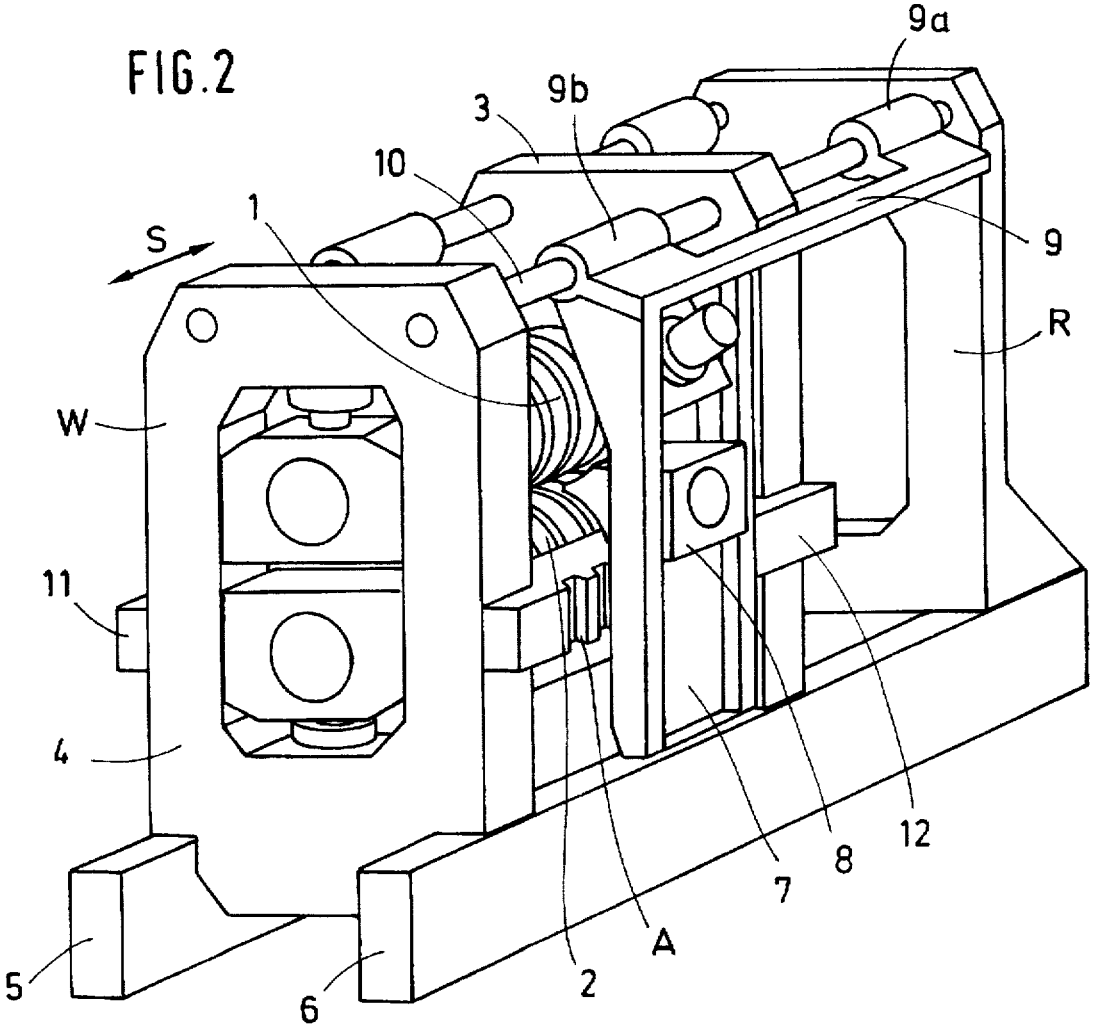
FIG. 2 is a perspective side view of an embodiment of the device according to the invention.
Figure 3:
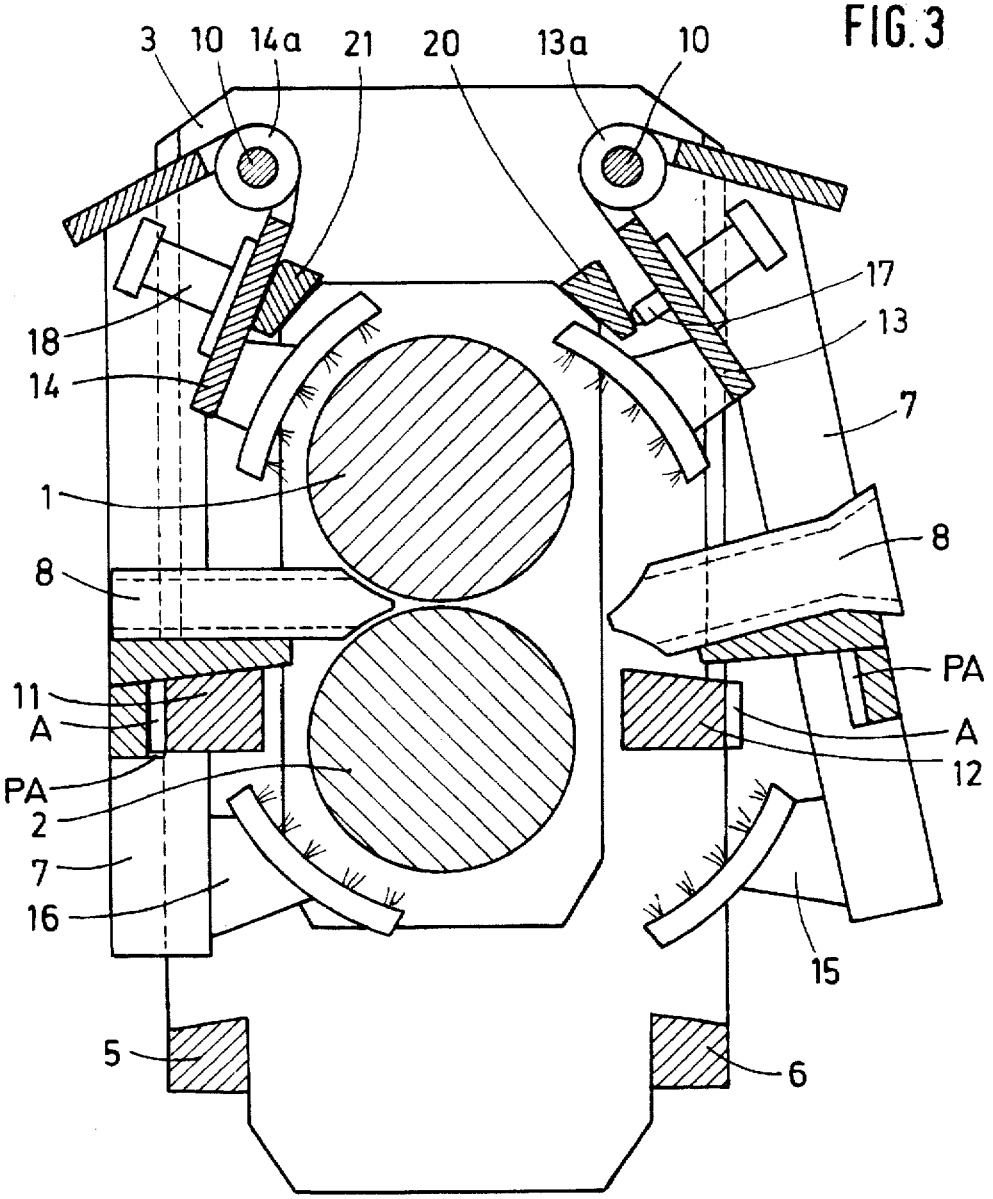
FIG. 3 is a sectional view, on a larger scale, of the embodiment of FIG. 2.
Figure 4:
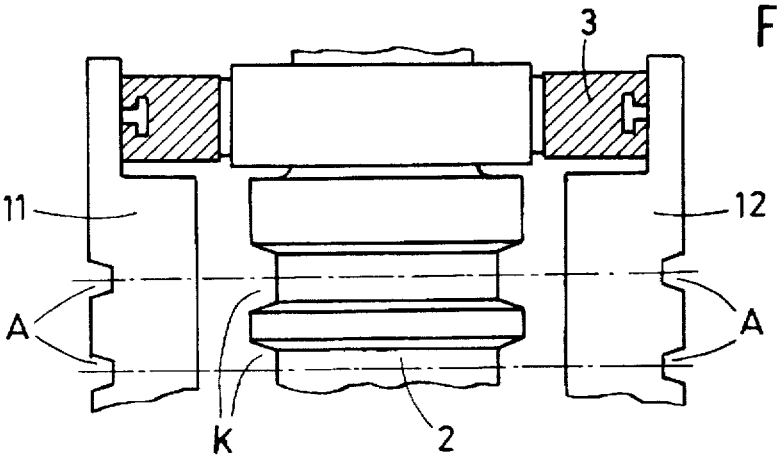
FIG. 4 is a partial sectional view of the embodiment of FIG. 3.

As illustrated in FIGS. 2, 3 and 4 of the drawing, a roll stand W provided with horizontal rolls 1 and 2 has roll housings 3 and 4 and is displaceably arranged on the bottom cantilevers 5 and 6 of a guide frame R. The guide frame R is displaceable in the direction of double arrow S shown in FIG. 2. The support 7 of roll fittings 8 is arranged on a hinge element 9 which is connected with a bearing sleeve 9*a* to the guide frame R, on the one hand, and is hinged, on the other hand, with another bearing sleeve 9*b* to a crossbar 10 which connects the two roll housings 3 and 4 above the horizontal rolls 1 and 2. Arranged in front of and behind the horizontal rolls 1 and 2 are the two rest bars 11 and 12 which are fixedly connected to the roll stands 3 and 4.

As particularly illustrated in FIGS. 3 and 4, the rest bars 11 and 12 have positioning recesses A which correspond to the grooves K of the horizontal rolls 1 and 2, wherein a positioning stop PA arranged on the support 7 of the roll fittings 8 can be moved into and out of the positioning recesses A by pivoting the support 7 about the axis of the crossbar 10.

Spray nozzle carriers 13, 14 and 15, 16 are arranged on the supports 7 above the roll fittings 8. By means of bearing sleeves 13*a* and 14*a*, the spray nozzle carriers 13, 14 located above the upper horizontal roll 1 are mounted so as to be pivotable on the crossbar 10 relative to the support 7. The hydraulic cylinders 17, 18 rest against bearing blocks 20 and 21 connected to the roll stands 3 and 4, respectively. This drive produces the pivoting movement of the support 7.

By means of displacement means which are not illustrated in the drawing, the roll stand W is displaced on the cantilevers 5, 6 in the direction of arrow S shown in FIG. 2 relative to the support 7 of the roll fitting 8 until the desired groove K of the rolls 1, 2 is located between the roll fittings 8. As shown in FIG. 3 of the drawing, the support 7 is in an outwardly pivoted position on the right hand side of FIG. 3. Subsequently, the support 7 with the roll fitting 8 is pivoted into the position shown on the left hand side of FIG. 3, so that positioning stop PA is inserted into the oppositely located positioning recess A in the rest bar 11 or 12. The conical shape of the outer wall of the positioning stop PA as well as of the inner walls of the positioning recess A causes an exact centering of the groove A relative to the roll center determined by the positioning stop PA.

Figure 5:
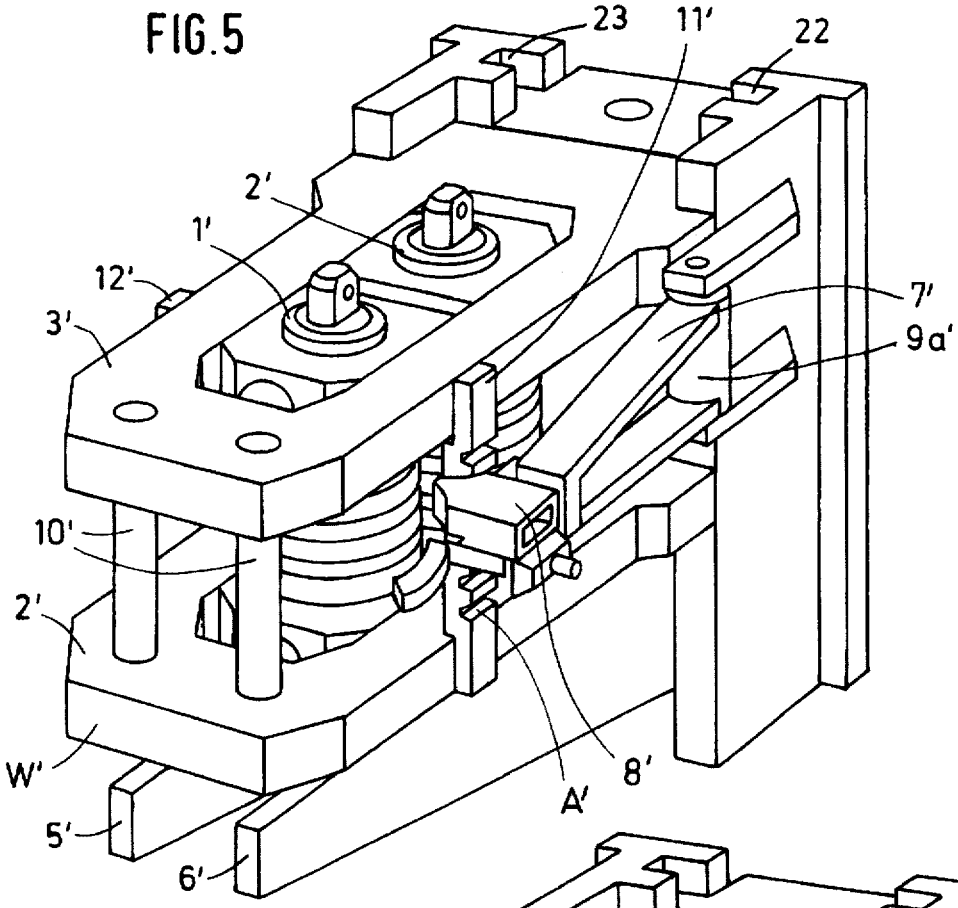
FIG. 5 is a perspective front view of another embodiment of the device.
Figure 6:
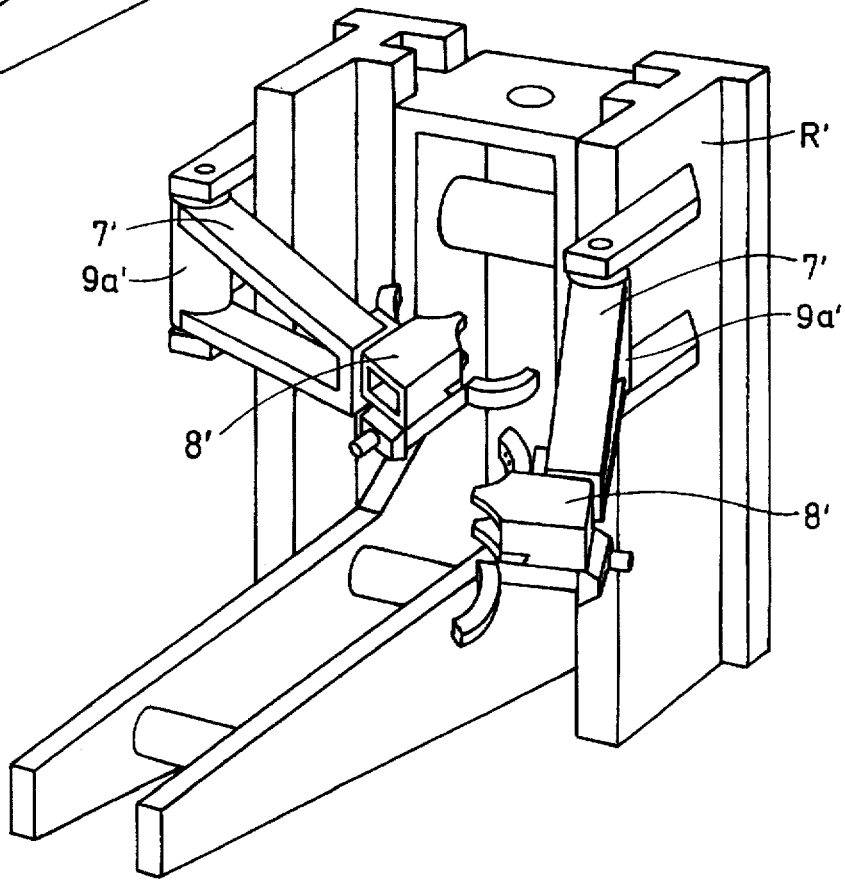
FIG. 6 is a partial illustration of the embodiment of FIG. 5.

The configuration according to FIGS. 5 and 6 corresponds to that of FIGS. 2–4, with the exception that FIGS. 5 and 6 show a roll stand W' for vertical rolls 1', 2'. In this embodiment, the support 7' of the roll fittings 8' is hinged with a bearing sleeve **9*a'* to the guide frame R'. The positioning stop, not shown in FIGS. 5 and 6, engages in the positioning recesses A' in the rest bar 11' shown in FIG. 5. In this embodiment, the roll stand W' is not displaced on cantilevers 5', 6', but in guide grooves 22, 23** of the guide frame R'.

Figure 1:
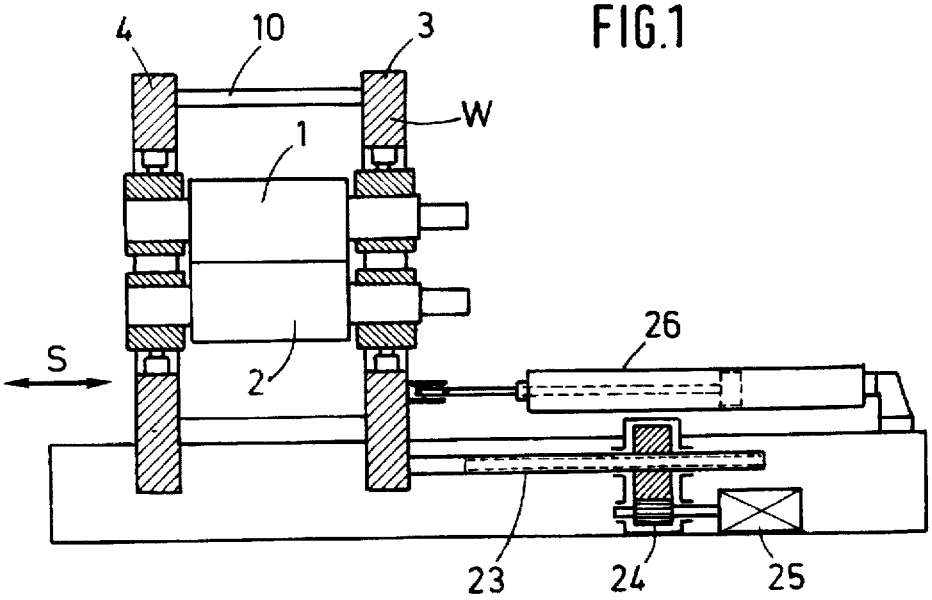
FIG. 1 is a side view, partially in section, of the device according to the present invention.

FIG. 1 of the drawing shows a displacement device for the roll stand W which is composed of the roll housings 3, 4, the cross bar 10 and the horizontal rolls 1 and 2 and which is displaceably guided on a guide frame R so as to be displaceable in the direction of double arrow S. A threaded spindle 23 of a spindle gear unit 24 driven by a motor 25 acts on the roll stand W. The displacement is effected against the force of a piston/cylinder unit 26 which eliminates the play occurring in the displacement direction.

While specific embodiments of the invention have been shown and described in detail to illustrate the inventive principles, it will be understood that the invention may be embodied otherwise without departing from such principles.

We claim:

1. A device for automatically positioning a horizontal roll stand having two housings, grooved rolls and rest bars and roll fittings in front of the grooved rolls relative to roll center, the device comprising a stationary guide frame, supports for the roll fittings mounted on the stationary guide frame, the roll stand being mounted on the guide frame so as to be displaceable relative to the support of the roll fittings and so as to be fastenable relative to the support, wherein the supports of the roll fittings are hinged to the guide frame so as to be pivotable about an axis extending parallel to roll axes and transversely to a rolling direction, and wherein the rest bars are fixedly attached to the roll stand and have positioning recesses corresponding to grooves of the rolls, and wherein the support of the roll fittings has a positioning stop mounted so as to be insertable in the recesses, further comprising a pair of crossbars rigidly connected to the guide frame and extending above the rolls parallel to the roll axes, the housings being displaceably mounted on the crossbars, wherein the supports of the roll fittings are hinged to the crossbars.

2. The device according to claim 1, further comprising a hinge element connected to the support for the roll fittings, the hinge element comprising first and second hinge bearings mounted on the crossbeam, the first hinge bearing being arranged between the two housings of the roll stand, and the second hinge bearing being mounted between the roll stand and a connection of the crossbeams to the guide frame.

* * * * *